United States Patent [19]

Hyler

[11] 3,971,147

[45] July 27, 1976

[54] TORQUE-LIMITED DRIVING ARRANGEMENT FOR SCRAPER ELEVATOR

[75] Inventor: John H. Hyler, Peoria, Ill.

[73] Assignee: Westinghouse Air Brake Company, Pittsburgh, Pa.

[22] Filed: Mar. 31, 1975

[21] Appl. No.: 563,486

[52] U.S. Cl. ..... 37/8; 198/203

[51] Int. Cl.[2] ..... B60P 1/36

[58] Field of Search ..... 37/8; 198/203; 74/572, 74/573, 199, 413

[56] References Cited

UNITED STATES PATENTS

| | | | |
|---|---|---|---|
| 2,478,227 | 8/1949 | Bawnister | 74/199 |
| 2,523,887 | 9/1950 | Thomson et al. | 198/203 |
| 2,965,217 | 12/1960 | Dommann et al. | 37/8 X |
| 3,076,540 | 2/1963 | Christian | 198/203 |
| 3,424,029 | 1/1969 | Horsch et al. | 37/8 X |
| 3,483,639 | 12/1969 | Eftefield et al. | 37/8 |
| 3,526,978 | 9/1970 | Jordan | 37/8 |
| 3,559,312 | 2/1971 | Fox et al. | 37/8 |
| 3,635,320 | 1/1972 | Capanna | 74/572 |
| 3,668,794 | 6/1972 | Marquardt et al. | 37/8 |
| 3,738,031 | 6/1973 | Lott | 37/8 |

*Primary Examiner*—E. H. Eickholt

*Attorney, Agent, or Firm*—Leydig, Voit, Osann, Mayer & Holt, Ltd.

[57] ABSTRACT

An elevator for loading a scraper bowl having a frame which extends upwardly and rearwardly from a scraper blade and which has, at the top of the frame, a chain drive including a speed reduction gear box and an electric motor having an armature coupled to the input of the gear box, the armature serving as a flywheel. Interposed between the motor shaft and the gear box, is a friction slip clutch. The torque of the slip clutch is set so that it remains non-slipping for all normal load to which the elevator may be subjected, including peak loads, while capable of intentional slippage when the elevator engages a boulder or other stubborn or positive obstruction, thereby to prevent the energy stored in the rotating armature, upon sudden deceleration of the drive, from developing a dangerous level of torque in the gear box. A hollow-shaft motor is used, and a friction slip clutch, having concentric input and output shafts, is cantilevered at the remote end of the motor, with the output shaft of the clutch being telescoped through the motor shaft and into the input connection of the gear box. It is one of the features of the construction that the motor, instead of occupying the usual position projecting outboard of the elevator frame at the upper end of the elevator, is coupled to the drive shaft by a gear box of flat configuration nesting closely against the elevator frame, with both the inlet connection and the outlet connection of the gear box facing inwardly of the frame, so that the motor occupies a "reentrant" position extending into the unused space between the runs of the conveyor chain. In the preferred form of the invention the motor extends into a tubular cross member forming a part of the frame and which serves to protect the motor. In lieu of an electric motor an hydraulic motor, having a flywheel directly connected to its rotor, may be used in the system.

15 Claims, 7 Drawing Figures

Fig. 1.
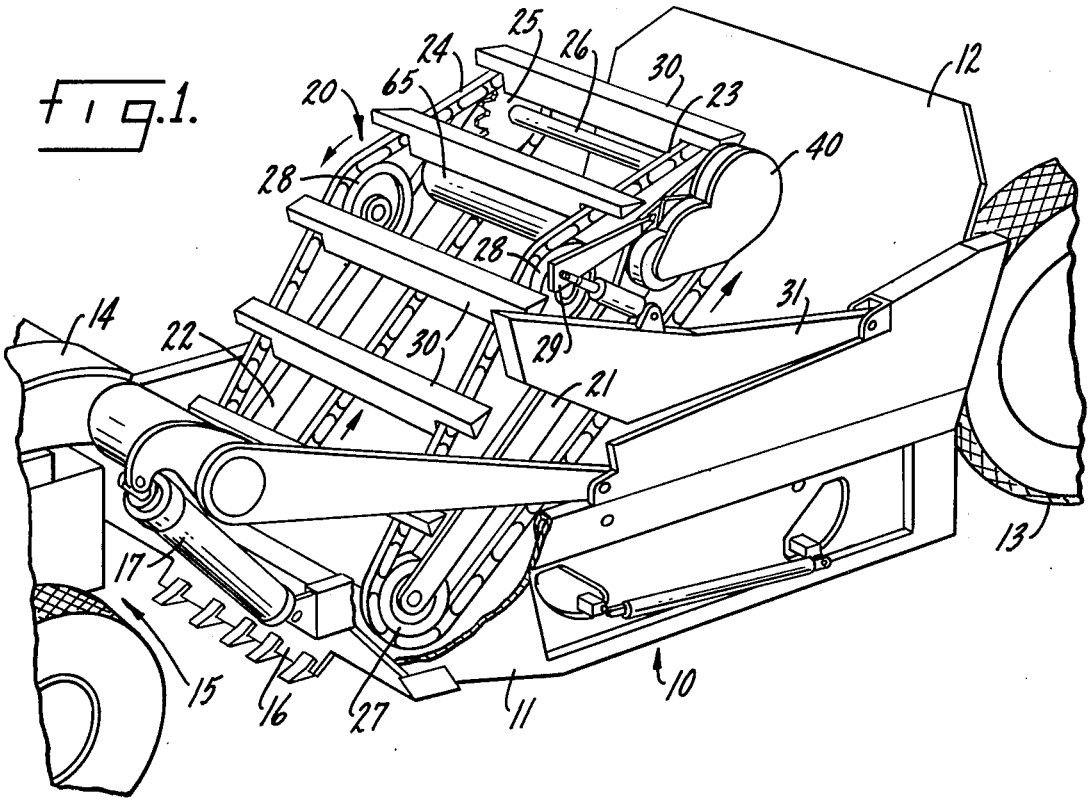
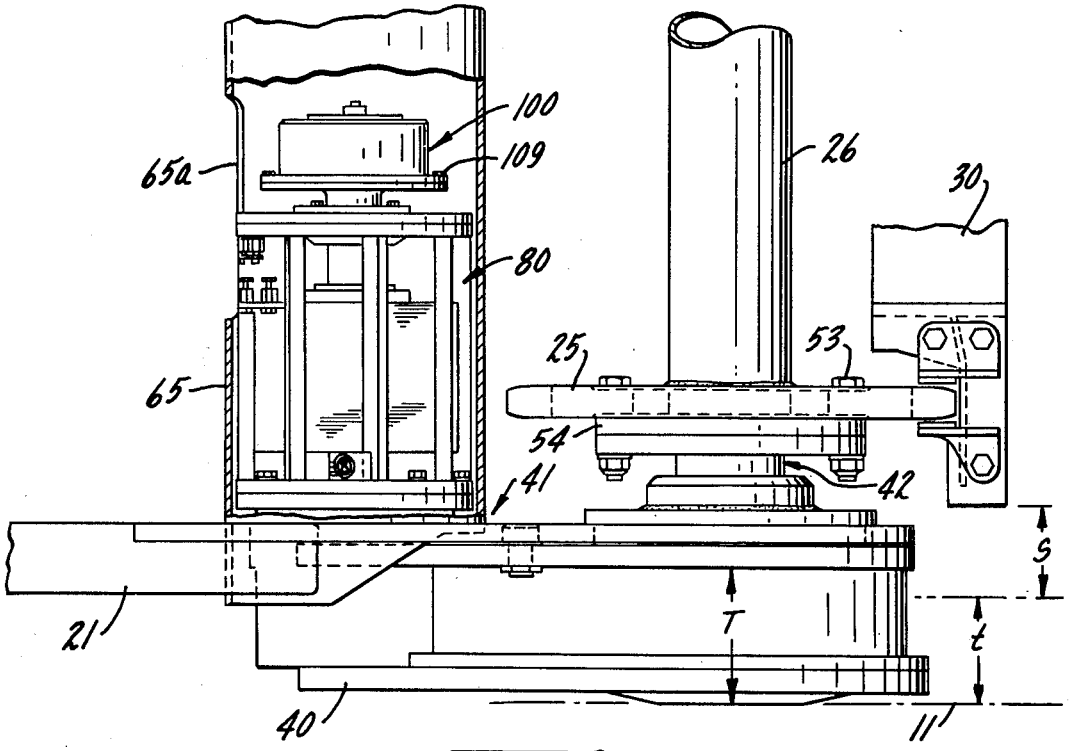
Fig. 2.

TORQUE-LIMITED DRIVING ARRANGEMENT FOR SCRAPER ELEVATOR

BACKGROUND OF THE INVENTION

This application is related to copending application Ser. No. 558,226 filed Mar. 14, 1975.

The invention relates generally to an elevator for an earth-moving scraper and more particularly to a high inertia drive having torque capability to overcome normal peaks of loading but with provision for protecting the mechanism, internally against build-up of torque to a destructive level and externally against applied blows or other abuse.

An elevator used with a large scraper bowl must operate constantly under abusive conditions since, in addition to elevation of soil, the elevator must successfully accommodate all sorts of surface debris including boulders of various size, branches and roots, and often timbers and other heavy trash resulting from previous land fill. In order to prevent stalling in the face of normal peaks of loading while keeping the drive motor down to reasonable size, it has been known to employ a flywheel on the motor shaft. Unfortunately, when an elevator flight suddenly encounters a large boulder or similar obstruction, resulting in blockage of the flight, chains and drive shaft, the flywheel tends to continue to rotate because of its momentum. The sudden deceleration results in the setting up of a destructive torque which may result in over-stress or even breakage of one of the shafts or gears in the gear box. In short, the energy stored in the rotating system becomes of destructive effect.

Attempts have been made to provide some relief from peak torques by using an interposed fluid coupling. However, this has not worked out satisfactorily since the torque transmitted by a fluid coupling varies in accordance with the speed differential between the input and output elements resulting in relatively poor protection against suddenly imposed overloads while suffering slippage and loss of driving efficiency under more normal conditions. Also shear pins have been employed in order to preserve driving efficiency, but this results in expensive down time when replacement is required, and even disablement of the machine when the operator, as is likely, runs out of pins for replacement purposes.

With regard to external protection, it is the practice to mount the gear box and motor, stacked upon one another, in an outwardly projecting position at the top of the elevator where the assembly is exposed to self-inflicted blows when maneuvering in close quarters or to blows from other mobile equipment.

SUMMARY OF THE INVENTION

It is accordingly an object of the present invention to provide a driving arrangement for an earthmoving elevator which is highly efficient during normal operation but which is protected against damage both internally and externally. Efficiency is enhanced by using a drive connection which is non-slipping under all normal conditions, and by making use of the energy stored in the motor armature or close-coupled flywheel, while nevertheless protecting the associated gear train against the build-up of excessive torque in a blocking condition. This is accomplished by interposing a friction slip clutch between the motor and the armature having provision for adjustment to achieve a direct non-slipping drive connection under all normal conditions of loading, while slipping automatically, upon exceeding of a preset torque, when a severe obstruction is encountered, so that the maximum torque which is applied to the gears in the gear box is reliably limited to a level short of that which might cause breakage. This permits an electric motor or a flywheel-assisted hydraulic motor having high rotational inertia to be employed as may be desired to accommodate all peaks of loading within a normal range but with assurance that any excess of energy mechanically stored in the motor armature or flywheel will be harmlessly dissipated upon achievement of torque above the set level. While the friction clutch is functionally interposed between the motor and the gear box, the clutch is nonetheless physically mounted at the end of the motor in a position which permits the protective scheme to be applied to existing as well as new designs of elevator drives without mounting problems or other mechanical complication.

It is a further object of the invention to provide an elevator driving assembly which avoids the usual projecting, or cantilevered, construction and in which the gear box nests compactly against the elevator frame, with the drive motor, which is supported by the gear box, being mounted reentrantly in a protected position in the normally unused space between the runs of conveyor chain.

BRIEF DESCRIPTION OF THE DRAWINGS

FIG. 1 is a simplified perspective view of an elevator employing the present invention;

FIG. 2 is a fragmentary view of the drive assembly, with the tubular cross member broken away to reveal the drive motor;

Figure 3:
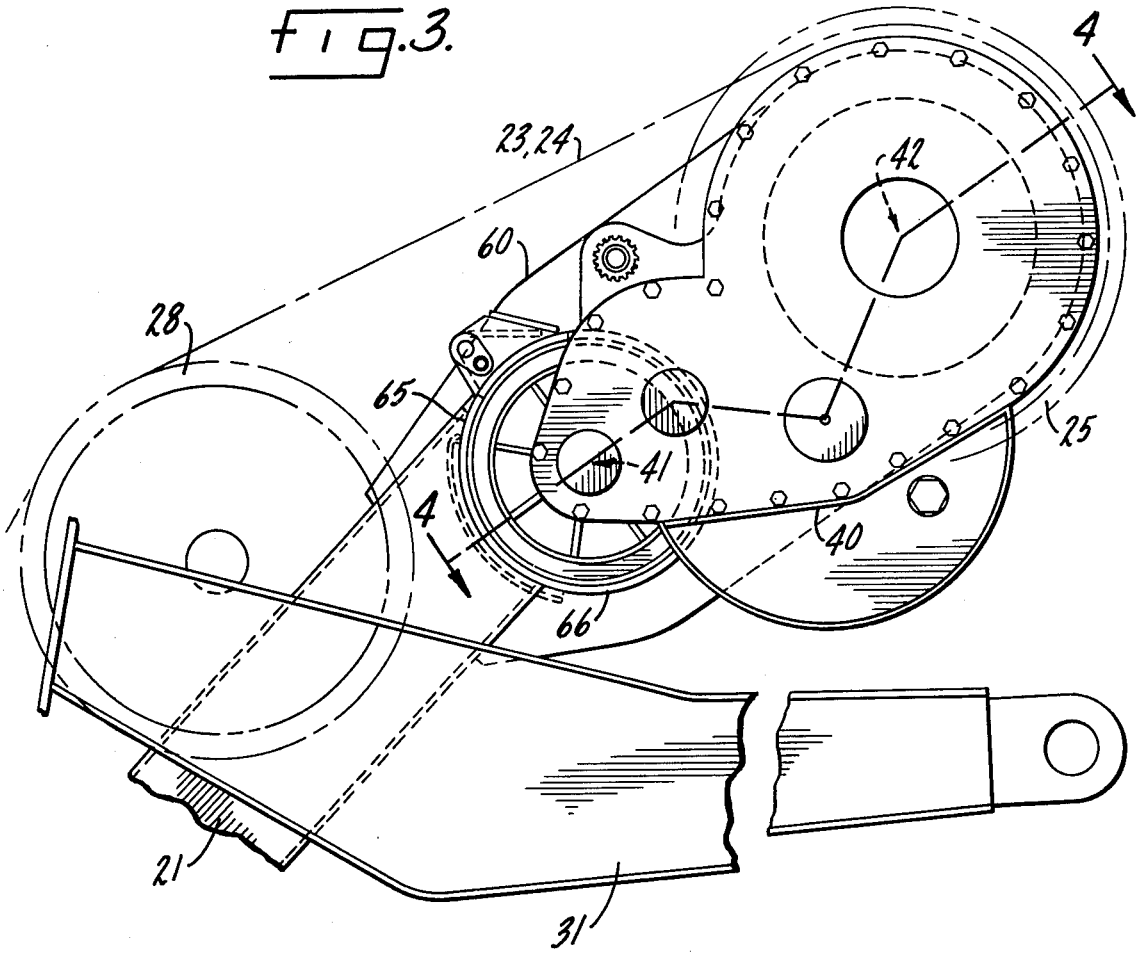
FIG. 3 is a fragmentary elevational view.

While the invention has been described in connection with a preferred embodiment, it will be understood that there is no intention to limit the invention to such embodiment and it is intended, on the contrary, to cover the various alternative and equivalent constructions included within the spirit and scope of the appended claims.

DETAILED DESCRIPTION OF THE PREFERRED EMBODIMENT

Referring now to the drawings, there is disclosed a scraper bowl 10 of open-fronted construction having side sheets 11 and a back 12 as well as a floor extending between the side sheets but which is not visible in the drawing. The bowl is supported at the rear upon ground wheels 13 and at the front by a draft frame 14 on the tractor 15. A scraper blade 16 digs into the ground to a depth which is determined by the adjustment of a pair of bowl hoist cylinders, one of which is shown at 17.

The elevator, generally indicated at 20, encloses the open front of the bowl, extending upwardly and rearwardly from the region of the blade. The elevator has a frame including longitudinal frame members 21, 22 mounting endless conveyor chains 23, 24. The chains are trained about sprockets 25 on a drive shaft 26 at the upper end, about rollers 27 at the lower end, and auxiliary idlers 28 at mid-position, the idlers being mounted on arms 29. The idlers 28 form a hump in the downward runs of chain, with the arms being held in extended position to maintain tension. For conveying the loosened soil into the bowl, transversely extending flights 30 are secured to the chains at spaced intervals. The elevator frame is swingably supported on the bowl on arms 31, only one of such arms being shown.

Figure 4:
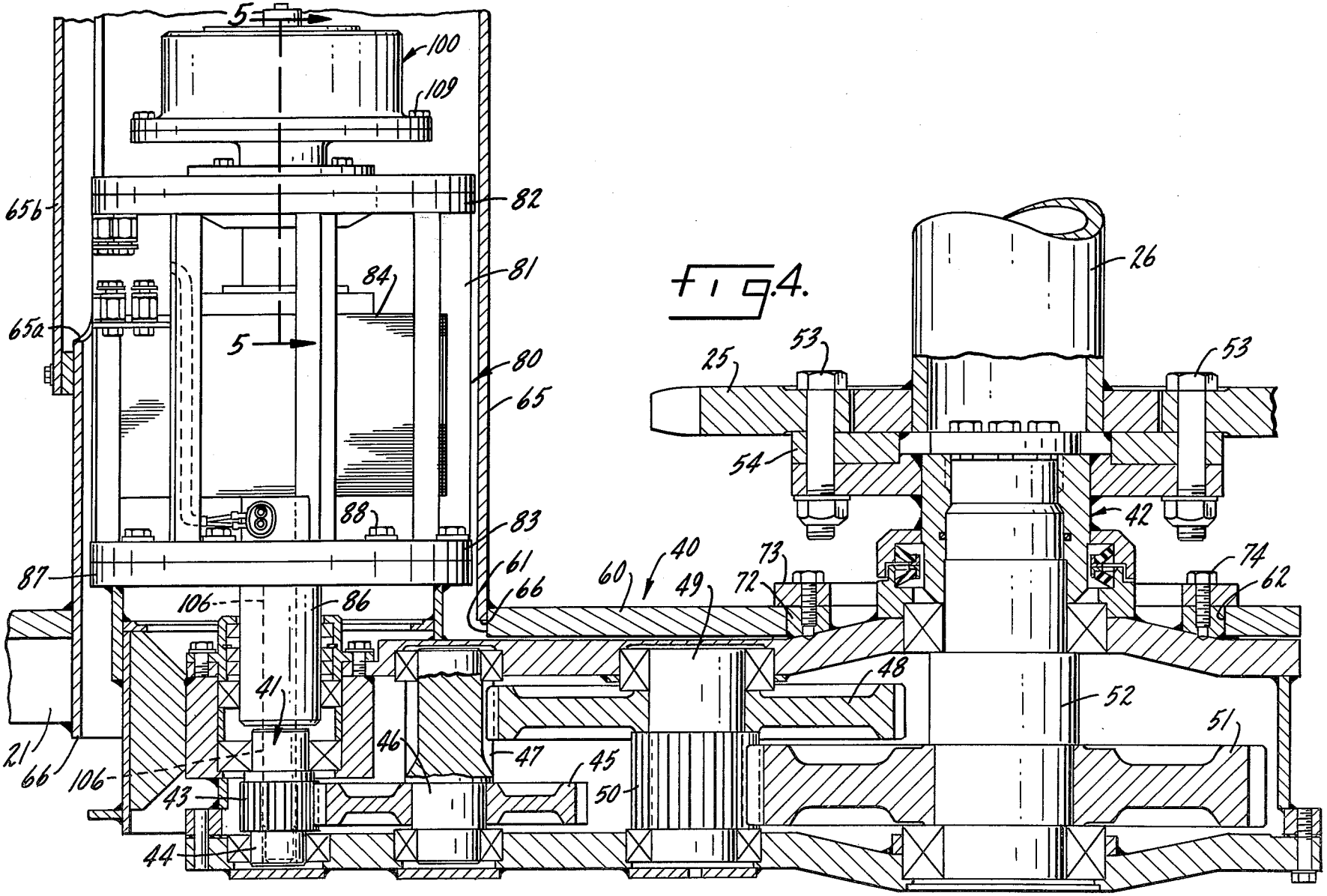
FIG. 4 is a section taken along the line 4—4 in FIG. 3.

For the purpose of powering the shaft 26, a drive train is provided including a gear box 40 having an input connection 41 and an output connection 42 parallel thereto. Interposed between the input and output connections is a train of speed reduction gears. The gear train includes a pinion 43 on a shaft 44 (FIG. 4). The pinion meshes with a gear 45 on a shaft 46 having an output pinion 47. The pinion 47, in turn, drives a gear 48 having a shaft 49 and pinion 50. Finally, the latter pinion drives a heavy duty gear 51 which is mounted on a large diameter shaft 52 which carries the output connection 42, the latter being in the form of a hub and circular mounting flange carrying the drive sprocket 25. The latter, which is preferably segmented, is secured by bolts 53, with an annular driving flange 54 sandwiched inbetween. By proper choice of relative pinion and gear size and choice of number of reduction stages, the overall gear reduction, from input to output, may be made as large as necessary, a reduction ratio of about 112:1 being employed in the illustrated embodiment.

It is one of the features of the construction that the gear box 40 is of elongated "flat" configuration, nesting compactly against the extended upper end of the longitudinal frame member 21. Preferably the longitudinal frame member 21 is of composite construction, with the lower portion being formed of box cross section and with an upper portion in the form of an elongated flat supporting plate 60 having an input clearance opening 61 and an output clearance opening 62.

Figure 2A:
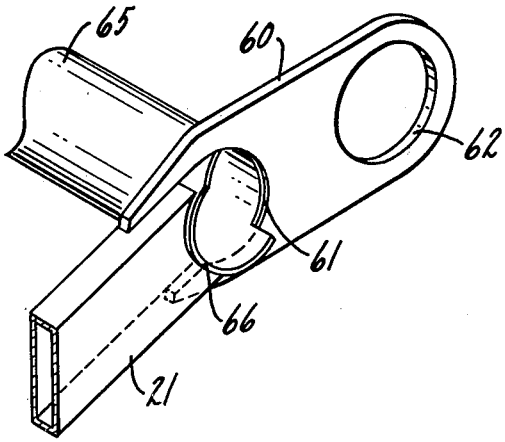
FIG. 2*a* is a fragmentary perspective showing the joint between frame member, cross tube and supporting plate.

For the purpose of providing transverse rigidification of the elevator frame, the longitudinal members 21, 22 of the frame, which are parallel to one another, are joined by a hollow tubular cross member 65 of relatively large diameter, a diameter which preferably equals or exceeds the cross sectional dimension of the frame members. The end of the tubular cross member, indicated at 66, which is open and accessible, is securely welded to both the frame member 21 and to the plate 60 (FIG. 2*a*), thereby rigidifying the joint between them. The plate 60 provides a strong extension for the frame member 21, and, being flat, elongated, and offset inwardly with respect to the member 21, provides a seating surface for compact nested reception of the "flat" gear box 40.

For mounting the gear box securely to the plate 60, the gear box is provided with a circular mounting ring 72 (FIG. 4) which is dimensioned to fit within the circular opening 62 in the plate, with the gear box being clamped in place by an annular retaining ring 73 held in place by a circle of clamping screws 74. To insure that the gear box is maintained in fixed angular position with respect to the plate 60 on which it is mounted, in spite of driving reaction forces, the gear box may be keyed to the plate by a pin or any other desired means.

For the purpose of driving the input connection 41 of the gear box, a motor 80 is provided having a cylindrical frame 81 and end bells 82, 83 enclosing field structure 84. Journalled in the end bells is a rotor formed of an armature 85 on a shaft 86. For securing the motor at right angles to the gear box, to make a unitary drive assembly, the gear box is provided with a mounting flange 87 to which the motor end bell 83 is fastened by means of a circle of mounting screws 88.

In carrying out the present invention the flat gear box 40 has its inlet and outlet connections facing in the same direction, that is, inwardly with respect to the elevator, so that the motor 80 is "reentrantly" received in the normally unused space between the runs of the conveyor chains, the motor 80 being telescoped within the cross member 65 so that it occupies a fully recessed and fully protected position.

In accordance with an important aspect of the present invention, a friction slip clutch is interposed between the motor shaft 86 and the gear box input connection 41, the clutch being set to provide a drive connection which resists slippage during normal loading of the flights, including anticipated peak loads, but which permits slippage upon blockage of the drive shaft when a flight engages a solid obstruction causing a predetermined level of torque to be exceeded. In carrying out the invention the motor shaft is hollow and the clutch is of the type having concentric input and output shafts, dynamically balanced, and with the output shaft of the clutch extending through the hollow motor shaft into splined engagement with the input connection 41 on the gear box. Thus, referring particularly to FIG. 5 of the drawings, the clutch assembly indicated at 100 has an annular housing which consists of an annular inner, or base, portion 101 which is secured to the hollow motor shaft and a cooperating cap portion 102. These portions carry opposed clutching shoes 103, 104. Relatively rotatable between the clutching shoes is a clutch disc or output element 105 which is secured to a relatively thin output shaft 106 which extends through the motor shaft 86 and the end of which is spline-connected to the input 41 of the gear box.

Means are provided for varying the static pressure applied between the shoes 103, 104 to the disc 105. This variation is brought about by mounting the shoe 104 on an annular keyed insert 107, with a spring 108 in the form of a pair of Bellville washers being interposed between the cap member 102 and the annular insert 107. The amount of axial spring force is established and adjusted by shimming between the portions 101 and 102 of the housing, which are clamped together by bolts 109, to the point that no relative slippage of the disc 105 will occur during all normal operating peaks of the elevator. However, should an elevator flight be seriously obstructed by a boulder, large branch or other impediment, causing abrupt deceleration of the motor armature 85, which acts as a flywheel, the predetermined level of torque will tend to be exceeded causing slippage at the clutch faces, thereby to limit the torque which is applied to the gear box to the predetermined level while simultaneously dissipating the kinetic energy which is stored in the rotating armature. Preferably an access opening 65*a* is provided in the wall of the tubular cross member 65, enclosed by a cover plate 65*b*, to permit inspection of the motor. It will be apparent that the tubular cross member, in addition to protecting the motor, fully encloses the clutch assembly 100 so that it is at all times freely rotatable without possibility of interference.

Under normal scraping and elevating conditions the drive train, including the friction clutch, is highly efficient as compared to hydraulic couplings since the kinetic energy which is stored in the armature 85 and in the rotating clutch assembly 100 is fully effective, without slippage, to augment the motor torque in overcoming peaks of loading. To increase the available kinetic energy, the clutch assembly 100 and particularly the housing portion 102 thereof, which are dynamically balanced, may be made more massive so that they have a higher degree of rotational inertia or flywheel action. The energy which is stored in the rotating flywheel and clutch assembly, upon sudden deceleration caused by blockage of a flight, may intentionally exceed the torque capability of the gear box. However, by use of the present invention the actual amount of torque which may be transmitted through the shaft 106 which feeds the input of the gear box is reliably limited by the adjustment of the slip clutch to that level which is within the safe capability of the gear box. Consequently, the motor armature 85 and the clutch assembly 100 may be designed with excess rotational inertia with assurance that no element of the gear box will ever become overloaded to the point which might cause breakage. This is true regardless of the speed at which the motor might be operated.

Not only is the motor protected against physical blows in its reentrant location, but it is also fully shielded against entry of dirt and other foreign material transported by the flight, thereby permitting use of a more open type ventilated motor distinguished by compactness and low cost.

It will be apparent that the main design factor limiting the utility of previous constructions, namely, the cantilevered overhang of motor and associated drive elements in a highly exposed position, has been eliminated, and, indeed, the present tubular accommodation insures that axial length is no longer a design limitation. This, combined with the high stepdown ratios obtainable by multi-staging in the flat elongated gear box, opens the door for the first time to use of powerful high speed electric motors of long, thin form factor. Instead of a liability by reason of speed and dimension, use of such a motor is, in the present construction, turned into an asset.

Regardless of the length of the motor, servicing is quick and easy. The bolts 53 securing the sprocket 25 and shaft 26 to the output flange 42 are removed, followed by unscrewing of the screws 74 and retainer ring 73 which secure the assembly to the mounting plate 60, following which the combined motor - gear box assembly may be axially withdrawn and a replacement unit substituted within a matter of minutes. Sufficient radial clearance preferably exists between the motor and inner wall of the tubular member to avoid contact or binding and to insure that the motor is supported by the gear box. If desired, the clearance may be increased beyond that shown to facilitate ventilation of the motor for cooling purposes.

Sufficient rotational inertia to overcome normal peaks of load will be provided by the armature 85 in commercially available types of motors and by the rotating friction clutch assembly 100. However in the event that a motor having a light weight armature is used, an auxiliary flywheel may be mounted upon such shaft without departing from the present invention, keeping in mind that such flywheel may be made intentionally oversized without hazard to the stepdown gearing. Thus the term "flywheel armature" as used herein refers to a motor rotor having substantial inertia capable of storing sufficient kinetic energy to overcome normal peaks in the operating load either with or without a supplemental flywheel.

The invention has been described above in connection with an electric motor since the armature of an electric motor is usually weighty enough to supply all of the flywheel effect reguired to overcome normal peak loads. However, the invention is not limited thereto and it is possible to carry out the invention employing an hydraulic motor, the rotor or armature of which is of inherently low inertia, the inertia being augmented by a flywheel which is close-coupled to the motor and which preferably carries the weighty portion of an associated clutch.

Figure 6:
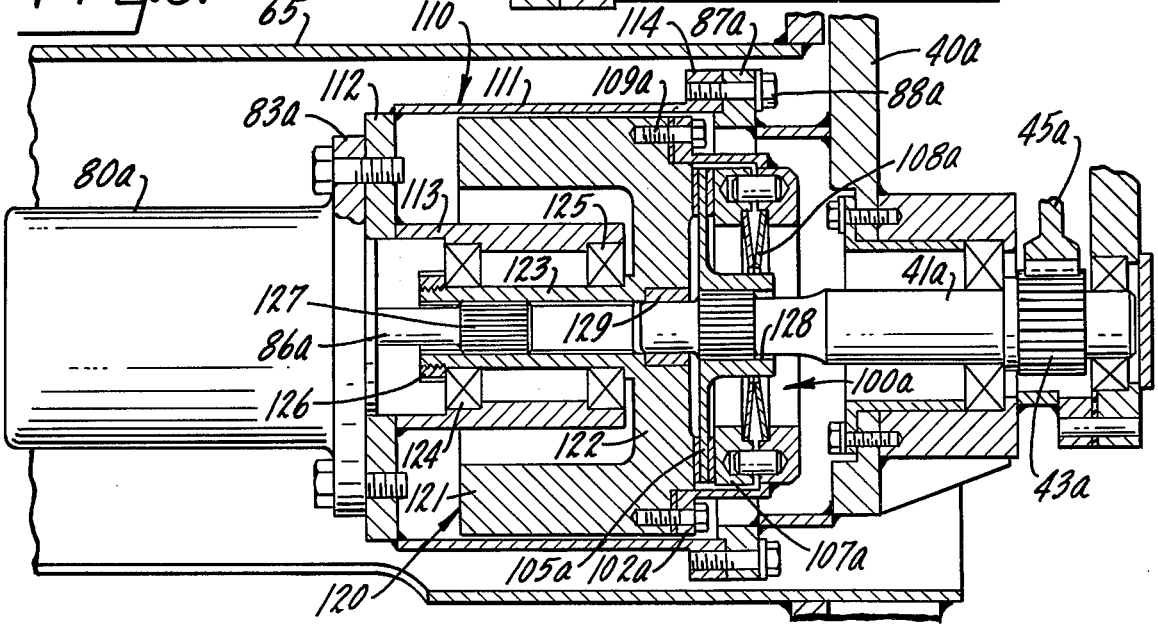
FIG. 6 is a cross sectional view showing a modified form of the present invention.

As shown in FIG. 6, in which elements in common with the prior construction are denoted by subscript *a*, the flywheel housing, indicated at 110, is of rather specialized construction having an outer cylindrical shell 111, an annular end member 112 and an internal "reentrant" mounting sleeve 113, thereby forming a cross section of E shape, with the shell and sleeve defining an annular space between them. Fitted into the housing is a complimentarily formed flywheel 120 having a weighty rim 121, an end wall 122 and a central shaft 123 so that the flywheel is of mating, oppositely facing, E-shape, with the rim being compactly telescoped into the annular space.

Interposed between the shaft 123 of the flywheel and the internal sleeve 113 of the housing are a pair of axially spaced bearings 124, 125, which provide stable central support, the shaft 123 having a bearing retaining nut 126 preventing the flywheel from moving endwise. The flywheel is thus journaled captively in, and fully supported by, the flywheel housing.

The motor, indicated at 80*a*, and which may be of the low inertia hydraulic type, has a flange 83*a* which is seated coaxially on the annular end member 112 of the housing 110. The housing in turn has a mounting flange 114 which seats on the mounting flange 87*a* on the gear housing, being securely clamped thereon by a ring of screws 88*a*.

For coupling the motor to the flywheel shaft 123, such shaft is internally splined, while the motor shaft 86*a* carries a mating external spline 127.

A slip clutch, generally indicated at 100*a*, is interposed between the flywheel and the gear box input shaft 41*a*. The clutch, similarly to that shown in FIG. 5, has a weighty peripheral portion including a cap 102*a* which, secured to the flywheel by bolts 109*a*, presses upon annular springs 108*a* which react against an annular insert 107*a* to apply torque to a central clutch output disc 105*a*. The latter has a spline connection 128 with the left-hand end of the gear box input shaft 41*a*. The remote, or left-hand, end of the shaft 41*a* is telescoped into an anti-friction pilot bushing 129 mounted at the right-hand end of the flywheel to provide outboard support for the shaft.

It will be apparent that the construction shown in FIG. 6 has the same features and advantages as that disclosed in FIG. 4. Although the motor may have inherently low inertia, the flywheel provides sufficient close-coupled inertia to overcome normal peaks of load imposed upon the elevator, with a portion of the flywheel effect being derived from the weighty peripheral portion of the clutch. The inertia of the flywheel, clutch combination may deliberately be made excessive since the interposition of the clutch between the flywheel and the input shaft 41*a* of the gear box puts a ceiling upon the torque which can be transmitted into the gear box, thereby protecting the gear train and its associated elements against imposition of excessive deceleration torque.

Figure 5:
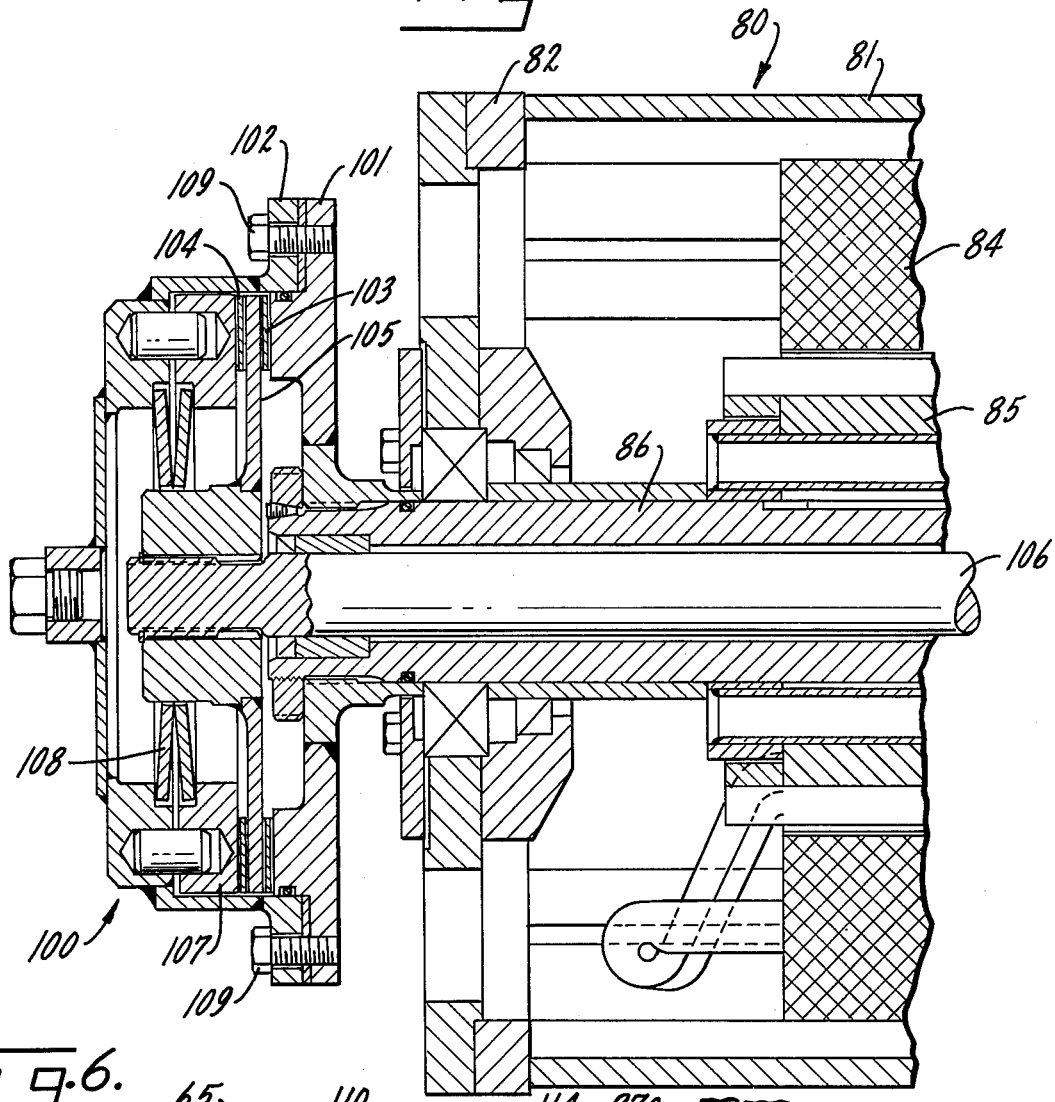
FIG. 5 is a cross section through the friction slip clutch and adjacent portion of the motor looking along line 5—5 in FIG. 4.

The construction shown in FIG. 6 is both economical and versatile, utilizing the same basic gear box as in the previous embodiment with equal advantage and protected to the same degree regardless of the choice of electric or hydraulic drive. One further advantage of the construction shown in FIG. 6 as compared to that of FIG. 5 is that lubricant from the gear box may be allowed to enter the flywheel housing, making it possible to dispense with seals between the two adajcent compartments.

The use of the term "of flat configuration" as applied to the gear box refers to the fact that the gears are strung out in a series, rather than being axially stacked, resulting in a housing which has a substantially greater length than it has axial thickness reducing overhang to nearly zero. Indeed, the axial thickness T of the gear box is only a small amount greater than the thickness *t* of side sheet (FIG. 2) with which it is vertically alined. This permits the bringing of the flight ends into close proximity to the side sheet, being separated therefrom by only a narrow clearance spacing S, so that efficiency is maximum while leakage of soil is sharply reduced.

Since the elevated soil tends to mound up critically in the bowl, the widely spaced sprockets and chains, which are located near the side sheets, need not operate submerged, reducing wear between those elements to a minimum and reducing the likelihood that a rock or other debris might become wedged between them. At the same time, because of the central motor location, flight clearance problems of the type which can result in jamming and catastrophic failure are entirely obviated.

What is claimed is:

1. In an earth moving machine of the type having a wheeled bowl assembly with an open front end defining a soil receptacle as well as a scraper blade mounted on said assembly adjacent the open end of the receptacle, the combination comprising an elevator having a frame inclined upwardly and rearwadly from the region of the blade and having lateral surfaces, the elevator having a pair of conveyor chains and a drive shaft at the upper end thereof mounting sprockets for driving the chains and having supportive rollers at the lower end, the chains having a series of flights for conveying soil from the blade upwardly and rearwardly for deposition in the receptacle, a step-down gear box at the upper end of the frame including a set of reduction gears and having an input connection and an output connection, the gear box being of thin, flat construction in the axial direction and presenting an inside surface lying flatly in a laterally accessible position adjacent one of the lateral surfaces of the elevator frame, the input and output connections being located in laterally spaced positions projecting from the inside surface of the gear box, the output connection being alined with and connected to the drive shaft, a driving motor coupled to the input connection, the motor having a flywheel mass, and a friction slip clutch interposed between the flywheel mass and the input connection of the gear box, the slipping torque of the friction clutch being set to provide a drive connection which resists slippage during normal loading of the flights including peak loads while permitting slippage upon blockage of the drive shaft when a flight engages a more stubborn obstruction causing the set level of torque to be exceeded thereby to dissipate the kinetic energy stored in the flywheel mass and to prevent the development of torque in the gear box at a destructive level.

2. The combination as claimed in claim 1 in which the motor has an outer end flange-mounted upon the gear box in alignment with the input thereof and an inner end, the motor being of the type having a hollow shaft, the friction slip clutch being mounted at the inner end of the motor and having concentric input and output shafts, the outer one of the shafts being connected to the motor shaft and the inner one of the shafts being telescopingly extended through the hollow motor shaft and into the gear box for driving the latter.

3. The combination as claimed in claim 2 in which the friction slip clutch has a housing which is secured to the outer one of the telescoped shafts and in which the clutch assembly is of dynamically balanced construction so that it, being bodily rotated at motor speed, serves as a flywheel for storage of kinetic energy to assist in overcoming variations in normal loading applied to the flights.

4. In an earth moving machine of the type having a wheeled bowl assembly with an open front end defining a soil receptacle as well as a scraper blade mounted on said assembly adjacent the open end of the receptacle, the combination comprising an elevator having a frame inclined upwardly and rearwardly from the region of the blade, the elevator mounting a pair of endless conveyor chains having spaced upward and downward runs, the frame having a drive shaft at the upper end thereof with sprockets for driving the chains and supportive rollers at the lower end, the chains having a series of flights for conveying soil from the blade upwardly and rearwardly for deposition in the receptacle, a drive train including a gear box of flat elongated configuration extending from the drive shaft downwardly along the frame and nested closely thereagainst, the gear box having a set of reduction gears and input and output connections, the input and output connections both facing inwardly of the frame, the output connection being coupled to the drive shaft, a motor having an integral flywheel mass mounted at right angles to the gear box and coupled to the input connection thereon so that the motor projects inwardly into a fully recessed position in the space between the runs of chain, and a friction slip clutch interposed in the drive train, the slip torque of the friction clutch being set to establish a drive connection which provides positive driving during normal loading of the flights including peak loads but which permits slippage upon blockage of the drive shaft when a flight engages a stubborn obstruction tending to cause the set level of torque to be exceeded, thereby to dissipate the kinetic energy stored in the flywheel mass and to preclude the development in the gear box of a destructive level or torque.

5. The combination as claimed in claim 4 in which the frame has a longitudinal member defining a clearance opening through which the motor extends into the space between the runs of chain.

6. In an earth moving machine of the type having a wheeled bowl assembly with an open front end defining a soil receptacle as well as a scraper blade mounted on said assembly adjacent the open end of the receptacle, an elevator comprising a pair of frame members inclined upwardly and rearwardly from the region of the blade, the frame members being interconnected by a hollow tubular cross member, a pair of endless conveyor chains having spaced upward and downward runs, the frame having a drive shaft at the upper end thereof mounting sprockets for driving the chains as well as supportive rollers at the lower end, the chains having a series of flights for conveying soil from the blade upwardly and rearwardly for deposition in the receptacle, a drive train including a gear box of flat elongated configuration extending from the drive shaft downwardly along the frame and nested closely thereagainst, the gear box having a set of reduction gears and inwardly facing input and output connections, the input connection being alined with the axis of the tubular cross member and the output connection being coupled to the drive shaft, a motor having an armature with an integral flywheel mass at right angles to the gear box in alignment with the input connection thereon and projecting inwardly into a fully recessed position in the tubular cross member, and a friction slip clutch in the tubular cross member interposed between the motor armature and the input connection, the slip torque of the friction clutch being set to establish a drive connection which provides positive driving during normal loading of the flights but which permits slippage upon blockage of the drive shaft when a flight engages a stubborn obstruction tending to cause the set level of torque to be exceeded thereby to dissipate the kinetic energy stored in the flywheel mass and to preclude development in the gear box of a destructive level of torque.

7. The combination as claimed in claim 6 in which the slip clutch is mounted at the inwardly projecting end of the motor.

8. The combination as claimed in claim 7 in which the slip clutch is of the type having concentric telescoped input and output shafts, the outer one of the shafts being connected to the motor shaft.

9. In an earth moving machine of the type having a wheeled bowl assembly with an open front end defining a soil receptacle as well as a scraper blade mounted on said assembly adjacent the open end of the receptacle, the combination comprising an elevator having a pair of parallel frame members inclined upwardly and rearwardly from the region of the blade and structurally interconnected by a cross member, a pair of endless conveyor chains having spaced upward and downward runs supporting a series of flights for conveying soil from the blade upwardly and rearwardly for deposition in the receptacle, one of the frame members having an extension in the form of a flat supporting plate at its upper end, a gear box of flat elongated configuration mounted on the supporting plate, the gear box having a set of reduction gears and spaced parallel input and output connections facing in the same direction, a chain drive shaft at the top of the frame connected directly to the output connection of the gear box and mounting sprockets for driving the chains, a motor having an integral flywheel mass mounted upon the gear box in alignment with the input connection, a friction slip clutch for coupling together the motor with its flywheel mass and the input connection, the motor and clutch projecting reentrantly into a fully recessed position in the unused space between the runs of the chains.

10. In an earth moving machine of the type having a wheeled bowl assembly with an open front end defining a soil receptacle as well as a scraper blade mounted on said assembly adjacent the open end of the receptacle, an elevator comprising a pair of frame members inclined upwardly and rearwardly from the region of the blade, the frame members being interconnected by a hollow tubular cross member, a pair of conveyor chains having spaced upward and downward runs, the frame having a drive shaft at the upper end thereof mounting sprockets for driving the chains as well as supportive rollers at the lower end, the chains having a series of flights for conveying soil from the blade upwardly and rearwardly for deposition in the receptacle, a drive train including a gear box of flat elongated configuration extending from the drive shaft downwardly along the frame and nested closely thereagainst, the gear box having a set of reduction gears and inwardly input and output connections, the input connection facing along the axis of the tubular cross member and the output connection being coupled to the drive shaft, a motor having its outer end mounted upon the gear box and having a hollow shaft in alignment with the input connection thereon, the motor having an inner end, and a friction slip clutch at the inner end of the motor, the friction slip clutch having an input element and an output element, the input element being connected to the hollow shaft for rotation therewith and the output element being connected to a central shaft facing which penetrates the hollow shaft and which is connected to the input connection at the gear box, the friction slip clutch being set to establish a drive connection which provides positive driving during normal loading of the flights but which permits slippage upon blockage of the drive shaft when a flight engages a stubborn obstruction causing a predetermined level of torque to be exceeded thereby to dissipate the kinetic energy stored in the armature and to preclude development in the gear box of a destructive level of torque, the motor and slip clutch being protectively telescoped into a fully recessed position in the tubular cross member.

11. In an earth moving machine of the type having a wheeled bowl assembly with an open front end defining a soil receptacle as well as a scraper blade mounted on said assembly adjacent the open end of the receptacle, the combination comprising an elevator having a frame inclined upwardly and rearwardly from the region of the blade, the elevator having a pair of conveyor chains and a drive shaft at the upper end thereof mounting sprockets for driving the chains as well as supportive rollers at the lower end, the chains having a series of flights for conveying soil from the blade upwardly and rearwardly for deposition on the receptacle, a step-down gear box at the upper end of the frame including a set of reduction gears and having an input connection an an output connection, the gear box being of thin, flat construction in the axial direction and presenting an inside surface lying flatly in a laterally accessible position adjacent one of the lateral surfaces of the elevator frame, the input and output connections being located in laterally spaced positions projecting from the inside surface of the gear box, the output connection being alined with and connected to the drive shaft, a driving motor coupled to the input connection, a flywheel close-coupled to the motor shaft, bearings associated with the flywheel for independently supporting the same, a friction slip clutch having relatively slippable portions coaxially arranged interposed between the flywheel and the input connection of the gear box and with means for adjusting the torque at which slippage takes place, the slipping torque of the friction clutch being set to provide a drive connection which resists slippage during normal loading of the flights including peak loads while permitting slippage upon blockage of the drive shaft when a flight engages a more stubborn obstruction causing the set level of torque to be exceeded thereby to dissipate the kinetic energy stored in the flywheel and to prevent the development of torque in the gear box at a destructive level.

12. The combination as claimed in claim 11 in which the flywheel has a cylindrical housing having an inner mounting flange secured to the gear box and an outer oppositely facing mounting flange mounting the motor in coaxial position, and means for independently journalling the flywheel captively in the housing.

13. The combination as claimed in claim 12 in which the fywheel housing has an E-shaped axial section including an internal axial mounting sleeve defining an annular chamber within the housing, the flywheel being of oppositely facing E-shaped axial section including a peripheral portion telescoped into the annular chamber and a central stub shaft telescoped into the mounting sleeve, axially spaced antifriction bearings between the flywheel shaft and the mounting sleeve mounting the flywheel for free rotation, and means associated with the bearings for maintaining the flywheel axially captive within the housing.

14. The combination as claimed in claim 13 in which the central stub shaft is hollowed to provide an internal spline connection with the motor shaft and in which the input connection to the gear box is in the form of a shaft, the outer tip of which is telescoped into the flywheel to provide a freely rotatable pilot connection therewith.

15. In an earth moving machine of the type having a wheeled bowl assembly with an open front end defining a soil receptacle as well as a scraper blade mounted on said assembly adjacent the open end of the receptacle, the combination comprising an elevator having a frame inclined upwardly and rearwardly from the region of the blade, the elevator having a pair of conveyor chains and a drive shaft at the upper end thereof mounting sprockets for driving the chains and having supportive rollers at the lower end, the chains having a series of flights for conveying soil from the blade upwardly and rearwardly for deposition in the receptacle, a step-down gear box at the upper end of the frame including a set of reduction gears, the gear box having an output connection connected to the drive shaft and having an input shaft, means defining a flywheel housing on the gear box arranged coaxially with the input shaft, a flywheel journaled in the flywheel housing, a friction slip clutch having a weighty peripheral portion and a central disc portion, the peripheral portion being mounted upon the flywheel and the central disc portion being mounted at the end of the gear box input shaft, and an hydraulic motor flange-mounted on the flywheel housing having a projecting shaft extending coaxially into coupled engagement with the flywheel, the slipping torque of the friction clutch being set to provide a drive connection which resists slippage during normal loading of the flights including peak loads while permitting slippage upon blockage of the drive shaft when a flight engages a more stubborn obstruction causing the set level of torque to be exceeded thereby to dissipate the kinetic energy stored in the flywheel and to prevent development of a torque in the gear box at a destructive level.

* * * * *